United States Patent [19]

Brammer

[11] Patent Number: 4,714,111

[45] Date of Patent: Dec. 22, 1987

[54] WEIGHT/PRESSURE SET PACK-OFF FOR SUBSEA WELLHEAD SYSTEMS

[75] Inventor: Norman Brammer, Ventura, Calif.

[73] Assignee: Vetco Gray Inc., Houston, Tex.

[21] Appl. No.: 891,704

[22] Filed: Jul. 31, 1986

[51] Int. Cl.[4] ..... E21B 33/04

[52] U.S. Cl. ..... 166/182; 285/18; 285/141

[58] Field of Search ..... 166/182, 181, 208, 123, 166/124, 125, 195; 285/34, 18, 39, 342, 348, 147, 139, 142, 143, 321, 141

[56] References Cited

U.S. PATENT DOCUMENTS

| | | | |
|---|---|---|---|
| 2,849,245 | 8/1958 | Baker | 285/141 |
| 3,468,559 | 9/1969 | Ahlstone | 285/142 |
| 3,469,629 | 9/1969 | Adamache et al. | 166/182 |
| 3,926,457 | 12/1975 | Williams, Jr. et al. | 285/39 |
| 4,496,162 | 1/1985 | McEver et al. | 166/182 X |
| 4,509,594 | 4/1985 | Milberger et al. | 166/208 |
| 4,550,782 | 11/1985 | Lawson | 285/141 X |
| 4,607,865 | 8/1986 | Hughes | 285/18 |

FOREIGN PATENT DOCUMENTS

| | | | |
|---|---|---|---|
| 124468 | 11/1984 | European Pat. Off. | 285/18 |

*Primary Examiner*—James A. Leppink
*Assistant Examiner*—Hoang C. Dang
*Attorney, Agent, or Firm*—Joseph R. Dwyer

[57] ABSTRACT

A pack-off assembly (P) for a wellhead system (W) comprising of a pack-off nut (36) with a tapered pack-off (40). The pack-off nut (36), in one embodiment, contains an internally tapered split ring (44) having multi-start threads (46) for engaging similar mating multi-start threads (32) on the casing hanger (C). The casing hanger (C) external surface (20) is provided with a taper which faces the surrounding internal cylindrical wall (16) of the wellhead (W) thus providing a tapered annulus (14).

The pack-off assembly (P) is lowered to the wellhead (W) in a running tool (T) where the pack-off (40) is moved into the tapered annulus (14) without rotation of the pack-off nut (36) and the pack-off nut (36) is stabbed over (the mating threads (32, 46) ratchet) by the weight of the tubing string. Thereafter, system fluid pressure moves the pack-off assembly (P) further into the annulus (14) where the pack-off (40) engages an abutment and is compressed and expanded into sealing relationship with the internal and external surfaces of the annulus (14), respectively providing both a metal-to-metal seal and an elastomeric seal.

In another embodiment, the ring is a serpentine ring (44*a*) with multi-start threads (46*a*).

In still another embodiment, the split ring (46*b*) with the multi-start threads (46*b*) is provided with ramp-type thread locking means (92, 94).

11 Claims, 6 Drawing Figures

WEIGHT/PRESSURE SET PACK-OFF FOR SUBSEA WELLHEAD SYSTEMS

RELATED APPLICATIONS

The U.S. applications for Letters Patent of N. Brammer, one entitled "Wellhead System" Ser. U.S. Pat. No. 891,703 and another entitled "Wellhead Pack-off" Ser. No. 891,705, both filed July 31, 1986.

BACKGROUND OF THE INVENTION

This invention relates to wellhead systems and is specifically directed to seal assemblies, often referred to as pack-off assemblies, for sealing the annular space, often referred to as an annulus or gland, between a wellhead casing hanger and the surrounding cylindrical wall of a wellhead.

The U.S. Pat. No. 3,468,558 which issued as early as 1969, and later patents such as U.S. Pat. No. 3,871,449 explain the operation and purpose of pack-off assemblies as well as various ways of running and setting the pack-off, i.e., sealing the annulus.

These patents also show different types of pack-offs for these pack-off assemblies and U.S. Pat. Nos. 3,797,864 of Hines and Ortolon and 4,521,040 of Slyker and Pettit illustrate more recent pack-offs which comprise an elastomeric ring interposed between two metallic seal rings with each metallic seal ring having a pair or lips extending toward the elastomeric material. Upon compression of the elastomeric material, the lips are forces outwardly towards the surrounding walls to thus seal the annulus with both the elastomeric material and metal.

It is an object of this invention to improve such prior art pack-off assemblies with better sealing capabilities, minimum travel of the pack-off during setting, easy retrieval of the pack-off, and more importantly, provide a combination weight-set and pressure-set pack-off assembly.

SUMMARY OF THE INVENTION

The improvement in a pack-off assembly which meets the foregoing object comprises of a tapered pack-off mounted on a pack-off nut which contains an internally tapered split ring having multi-start threads for engaging similar mating multi-start threads on the casing hanger (inner tubular member). The casing hanger external surface is provided with a taper which faces the surrounding internal cylindrical wall of the wellhead (outer tubular member) thus providing a tapered annulus.

The pack-off, itself being tapered, is moved into the tapered annulus without rotation of the pack-off nut as the pack-off nut is stabbed over (the mating threads ratchet) by the weight of the tubing string. Thereafter, system fluid pressure move the pack-off assembly further into the annulus where the pack-off engages an abutment and is compressed and expanded into sealing relationship with the internal and external surfaces of the wellhead and casing hanger, respectively.

The depicted embodiment of the pack-off has an elastomeric ring between metallic seal rings with lips which are pressed against the internal and external surfaces by the compression of the elastomeric material providing both a metal-to-metal seal and an elastomeric seal.

In another embodiment, the split is a serpentine ring with multi-start threads.

Still another embodiment is a split ring with multi-start threads and with ramp-type backup means to lock the split ring onto the casing hanger.

DETAILED DESCRIPTION

Figure 1:
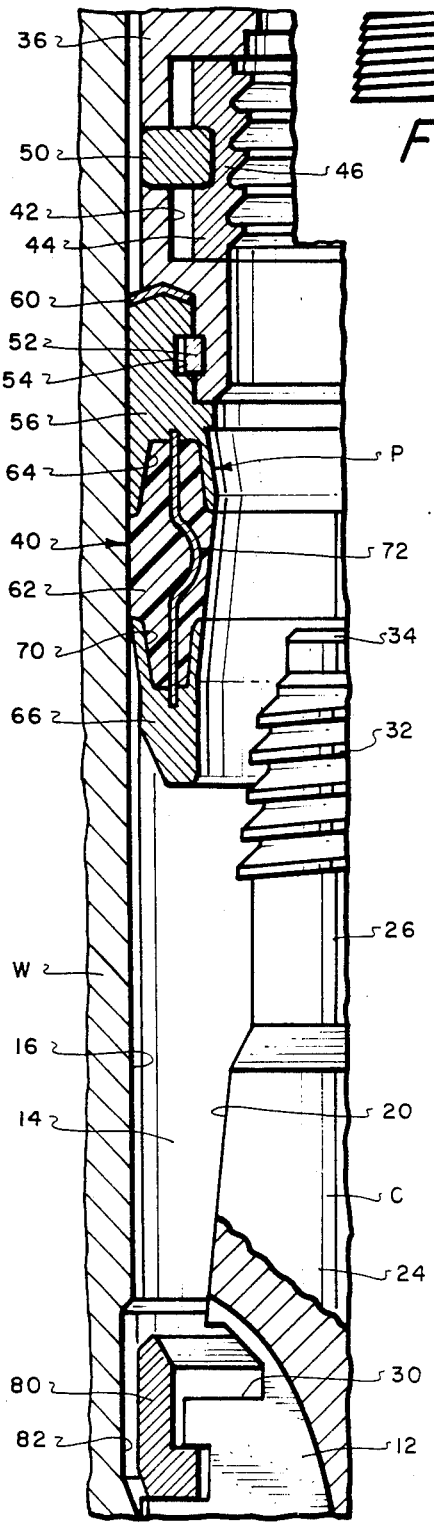
FIG. 1 is the partial cross-sectional elevational view of a wellhead system illustrating a pack-off seal assembly having a running nut with a split ring with multi-start threads and supporting a tapered pack-off, constructed in accordance with the teachings of this invention above a tapered annulus.
Figure 2:
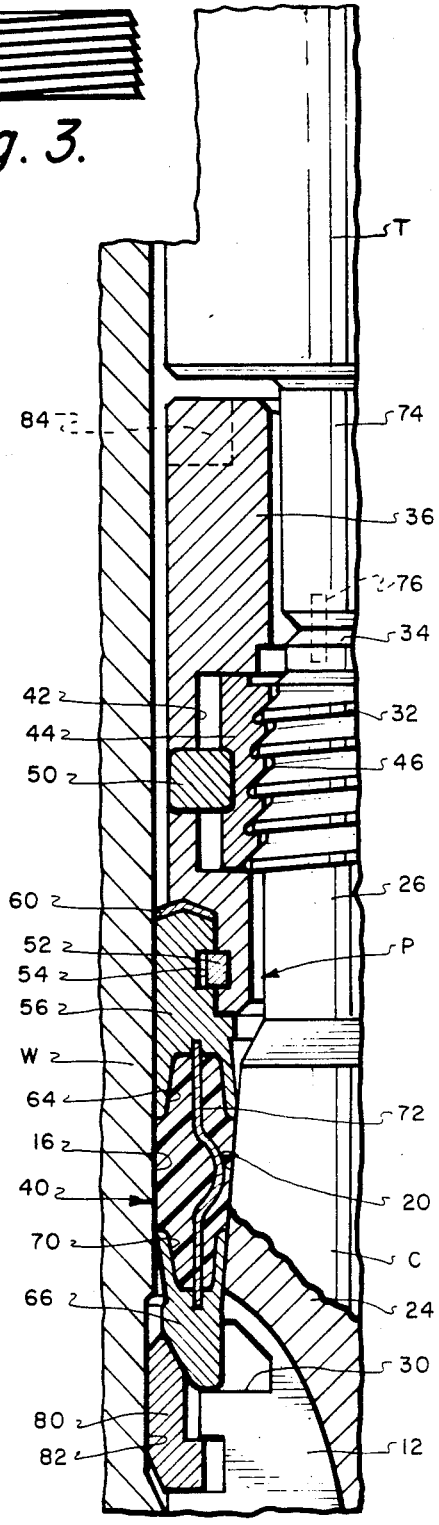
FIG. 2 is a view similar to FIG. 1 but showing the split ring of the running nut threaded onto mating threads on the casing hanger and the pack-off energized and set in the tapered annulus, thus sealing the latter.

In FIGS. 1 and 2 of the drawings, the invention is depicted already landed in a wellhead housing W (outer tubular member) with a casing hanger C (inner tubular member) and supported on a suitable outwardly facing seat or shoulder (not shown) in the bore of the wellhead housing W. Such a support for the casing hanger C in a wellhead housing is conventional and well known.

The casing hanger C and pack-off assembly P were assembled (made up) while on the vessel or platform, and lowered to the wellhead housing W on a running tool T which is conventionally connected to one end of a string of tubing, such as drill pipe. Whether or not the casing hanger C and the pack-off assembly P are lowered together, or two trips to the wellhead are required, one for setting the casing hanger C and the other to lower the pack-off assembly P and perhaps a wear bushing, is not material to this invention. The manner in which the pack-off assembly P is connected to running tool T is not material to this invention.

In the position shown in FIG. 1, circulating and cementing operations can be conducted in the usual manner through circulating passages 12 and annulus or space (gland) 14 between the cylindrical inner wall, or bore, 16 of the wellhead housing W and the opposing tapered wall 20 of the casing hanger C. After completion of the cementing operations, the annulus 14 is sealed by the pack-off assembly P. How this is accomplished will be described, infra.

The depicted casing hanger C comprises a main body section 24 integral with an upper section 26 and provided with a cylindrical inner bore, the circulating passages 12 and a pack-off actuating shoulder (abutment) 30. Not shown are threads at the lower end of the casing hanger to support threaded casing in the well in the conventional and known manner.

The casing hanger C differs from the prior art casing hangers in that the upper section 26 is conically tapered upwardly and provided with multi-start threads 32 immediately below the mouth 34 of the casing hanger C. Also, the wall 20 is also conically tapered in the same direction as the threaded upper section 26. The wall 20 thus defines the annulus 14 as tapered with its widest opening at the top.

Figure 3:
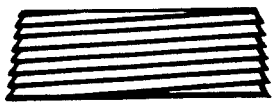
FIG. 3 is a schematic illustration of a multi-start thread of the prior art which is embodied in the first embodiment of this invention.

The multi-start threads 32 of the type formed on European Application No. 8401875.4 of Philippe C. Nobileau. This application was published May 2, 1985 (Publication No. 0 139 565) and in this European application the threads are illustrated on a pin and box connector. (FIG. 3 herein is a reproduction of one of the illustrations in the application.) As explained in this European application, after stabbing the pin and box, full make-up of the pin and box threads is accomplished by a rotation of a fraction of a turn, with the entire length of the threads fully engaged over the entire periphery of their interlocking surfaces since each thread extends over more than one turn. The amount of rotation depends inversely on the number of thread starts. Since the amount of travel of the running nut to set the pack-off may vary, the number of thread starts and thread pitch may be selected accordingly.

The pack-off assembly P includes a pack-off drive nut 36 and a pack-off, or seal portion, 40 connected to and supported by the pack-off drive nut 36. The pack-off drive nut 36 is cylindrical and provided with radially inwardly opening groove 42 containing a C-ring 44. The C-ring 44 is conically tapered at its inner side and provided with mating multi-start threads 46 to mate with the multi-start threads 32 on the casing hanger C. Relative rotation between the pack-off drive nut 36 and C-ring 44 is prevented by any suitable means such as pin 50.

The multi-start mating threads 32 and 46 may also be provided with a reverse taper on thread mating faces to help eliminate the tendency for the threads to be forced out of contact with each other under load. Such threads are referred to as wicker threads.

The pack-off 40 is of the type shown and more fully described in the U.S. Pat. No. 3,797,864 and in the U.S. Pat. No. 4,521,040, supra, and can be seen to include a swivel connection accomplished by a split retainer ring 52 mounted in complementary grooves 54 in a metallic support ring 56 and in the pack-off drive nut 36. A thrust bearing area 60 between the pack-off drive nut 36 and the support ring 56 permits rotation of the pack-off drive nut 36 without rotating the support ring 56. In the embodiment disclosed, the lower end of the support ring 56 engages and supports the upper end of a cylindrical elastomeric deformable packing ring 62 by a downwardly opening dovetail connection 64. A lower abutment metallic ring 66 is connected to the packing ring 62 by an upwardly opening dovetail connection 70. The support ring 56 and its dovetail connection 64 and the lower abutment ring 66 with its dovetail connection 70 also function as metal-to-metal seals when the pack-off is set. Because of their function, these rings and dovetail connections are also referred to as metallic seal rings and sealing lips, respectively. Also, this pack-off 40 is provided with a relatively thin curved cylindrical band 72 provided with long narrow slots (not shown) which form a plurality of Martin B. Jansen and John Pettit, Ser. No. 727,492 field vertical bands (also not shown) extending between the two metallic seal rings. The metallic band 72 is such that it does not interfere with the deformability of the elastomeric material but provides a mechanical connection between the upper and lower support and abutment rings and thus provide the pack-off assembly P with retrievable characteristics. A more complete explanation of a similar pack-off assembly with the retrievable characteristics is described and claimed in the U.S. patent application of Martin B. Jansen and John Petit, Ser. No. 727,492 filed Apr. 26, 1985 entitled "Retrievable Pack-Off" to which reference may be made if desired.

This pack-off 40 differs, however, from the above mentioned prior art pack-offs in that the upper support ring 56 is wider than the lower abutment ring 66 such that the relationship between the two is complementary to the annulus to be sealed.

In lieu of the tapered pack-off 40, the tapered pack-off which is described and claimed in U.S. patent application entitled "Wellhead Pack-off" identified, supra, under Related Applications may also be used. Reference can be made to that application for a complete description thereof if desired.

During running, the pack-off seal assembly is supported on the running tool T. Upon landing, a stem 74 on the running tool T engages the top of the casing hanger C where the entire load of the string in transferred to the casing hanger C. The expansion and contraction of the split ring 44 will allow the multi-start threads 32 and 46 to ratchet and to partially interengage with the split ring 44 in a partially expanded partially contracted condition. This with full interengagement having not been completed, and the pack-off 40, while having entered the annulus 14, is not fully energized. Suitable means, such as pins 76 (one shown in phantom), inhibit relative rotation between the casing hanger C and the running tool T.

It can be appreciated that the use of the tapered pack-off 40 in the tapered annulus 14 reduces the force necessary to move the pack-off 40 into the annulus 14 and does not require any energizing force until almost the very last moment when the lower abutment ring 66 engages the abutment 30 thus facilitating the use of system hydraulic pressure to set the pack-off after the pack-off assembly has been weight set on the casing hanger. In this intermediate position of the pack-off assembly P, system pressure is imposed upon the top of the pack-off nut 36 forcing the pack-off assembly to move downward causing the lower abutment ring 66 to engage the abutment 30. The elastomeric ring 62 is thus compressed and the upper and lower lips of the rings 56 and 66 form metal-to-metal seals and anti-extrusion barriers. The lower abutment ring 66 also engages a split ring 80 which is held on the casing hanger C and urges the split ring 80 into a groove 82 in the wellhead in order to lock the casing hanger C in the wellhead. At this time, the pack-off is considered set. For a complete explanation of how the lips of the sealing rings 56 and 66 react during movement of the pack-off downwardly into the annulus, reference is made to the Slyker and Pettit patent, supra.

As pointed out above, the taper of the multi-start threads 46 on the split ring 44, the tapered annulus 14, and the tapered pack-off 40 accomplishes the setting of the pack-off without rotational movement. These same features also permit the pack-off 40 to be retrieved with less than one turn of the running nut in the event the annulus seal is not fully effected. Grooves 84 (one shown in FIG. 2) in the top of the support ring 36 cooperate with lugs in a sleeve in a running tool to rotate the pack-off assembly for such retrieval.

Figure 4:
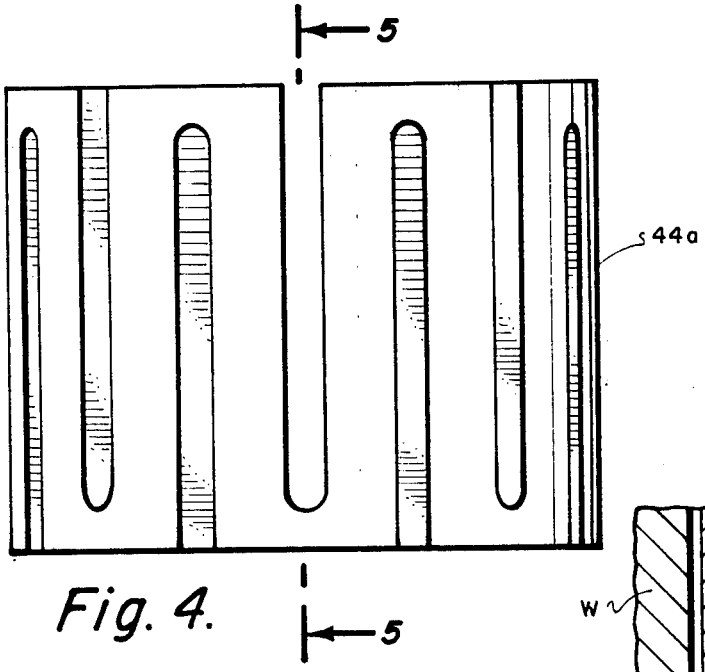
FIG. 4 is a second embodiment of the split ring utilizing a serpentine configuration.
Figure 5:
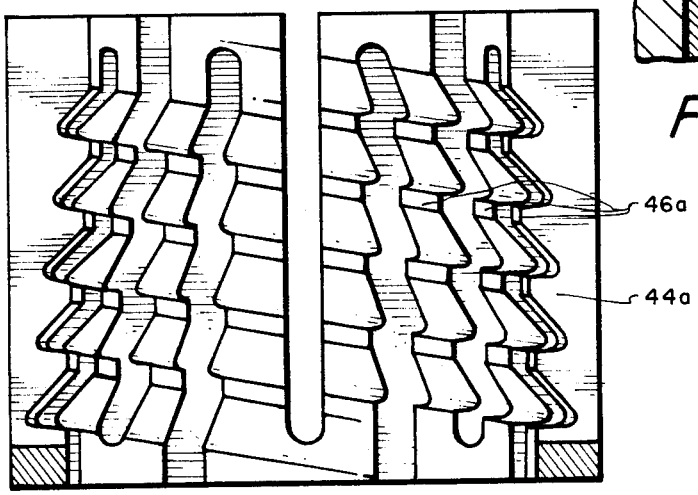
FIG. 5 is a cross-sectional view taken along line 5—5 of FIG. 4 and looking in the direction of the arrows.

Turning now to FIGS. 4 and 5 where part of the second embodiment of the invention is disclosed, it can be seen that the multi-start threads **46*a* are located on the inner wall of a serpentine ring 44*a*. This type of arrangement is similar in function and in operation to the split ring 44 in the first embodiment and would, of course, be positioned in groove 42 in the same manner. Too, as in the first embodiment, means such as key 50, though not shown in these figures, may be provided to prevent relative rotation between the pack-off nut 36 and the serpentine ring 44***a*.

Figure 6:
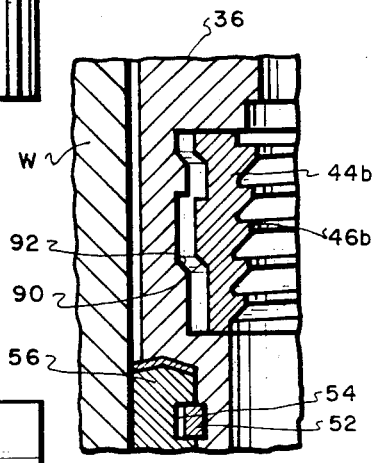
FIG. 6 is still another embodiment of the invention utilizing a ramp-type ring.

FIG. 6 illustrates still another ring 44*b*, which is also a split ring, as part of the third embodiment of the invention. Multi-start threads 46*b* interengage threads 32 on the casing hanger C in a manner similar to the threads of the C-ring 44 and the serpentine ring 44*a*. This ring, being split, is capable of ratchetring over the threads 32 on the casing hanger C in the same manner as the prior threads. As an option, if the operator drives to further lock the pack-off assembly to the casing hanger C, the pack-off assembly can be rotated further after the ratcheting takes place by the lugs of the running tool engaging slots 84 (FIG. 2) so that ramps 90 on the inner side of the C-ring 44*b* ramp up ramps 92 on the pack-off nut 36*b* thus locking the pack-off nut in the pack-off set position. The purpose of the ramps 90 and 92 is discussed at length in the David W. Hughes, U.S. patent application Ser. No. 661,502, filed Oct. 16, 1984 entitled "Connector, Ratcheting Type", and as pointed out therein the threads are not "wickered" since the ramps serve to lock the mating threads together. Reference is made to that application if more detail is thought necessary.

In the last two embodiments of the invention, the parts which operate the same as in the first embodiment are given the same reference numerals but with a suffix to simplify the description of these embodiments.

I claim:

1. In combination:

a vertical outer body member having an internal cylindrical sealing surface;

a vertical inner body member within said outer body member and having an external conical sealing surface;

said inner body member being radially spaced from said outer body member to define a tapered annulus between said sealing surfaces;

one of said body members having an abutment;

conically tapered multi-start threads on said inner body member, a tapered pack-off assembly including supporting means movable longitudinally toward said abutment;

said tapered pack-off assembly carried by said supporting means which when energized will sealingly engage said sealing surfaces of said annulus, said supporting means having a split ring capable of expanding and contracting radially, said split ring having conically tapered multi-start threads on its inner wall capable of mating with said multi-start threads on said inner body member, a running tool adapted for connection to a running string, means releasably connecting said supporting means to said running tool and positioning said pack-off assembly above said annulus, said running tool having means for engaging the top of said inner body member and which when engagement occurs said multi-start threads are partially overlapping and partially threaded and said tapered pack-off is partially within said tapered annulus but in unenergized condition, said partial overlapping and threading being a function of the weight of said running string and said split ring, and means for moving said pack-off assembly longitudinally toward said abutment to engage said abutment and expand said pack-off into an energized condition in sealing engagement with said sealing surfaces of said annulus.

2. The combination claimed in claim 1 wherein said ring is serpentine.

3. The combination claimed in claim 1 wherein said ring is split and further includes ramp means for locking said ring to said inner body member.

4. A well seal assembly for sealing between the interior surface of an outer tubular member and the exterior of an inner tubular member, said inner tubular member having a tapered surface spaced from and facing the interior surface of said outer tubular member to form a tapered annulus, comprising;

a seal assembly including, a tapered pack-off seal means, ring means, interengagable multi-start threads on said ring means and on said inner tubular member, said ring means being expandable and contractible and disposed in a concentric partially overlapping relationship with said inner tubular member so that the multi-start threads on said ring means will begin to ratchet over the multi-start threads on said inner tubular member by the expansion and contraction of said ring means over the multi-start threads of said inner tubular member when said seal assembly is intially and only partially within said tapered annulus, one of said tubular members having an abutment means, and means for further shifting said seal assembly toward and into engagement with said abutment means after said ratcheting has taken place without energization of said tapered pack-off seal means and then to compress and energize said tapered pack-off seal means into sealing engagement with said internal and external surfaces by engagement with said abutment means.

5. The well seal assembly as claimed in claim 4 wherein said multi-start threads on said ring means and said inner tubular member are mutually compatible and conically formed.

6. The well seal assembly as claimed in claim 5 wherein said ring means is split.

7. The well seal assembly as claimed in claim 5 wherein said ring means is serpentine.

8. The well seal assembly as claimed in claim 5 wherein said ring means is split and provided with ramp type locking means which lock the ring means and inner tubular member together when said seal assebly is in sealing engagment with said internal and external surfaces.

9. The well seal assembly as claimed in claim 4 wherein said initial and partial movement of said seal assembly is in response to weight imposed upon said seal assembly and wherein said further shifting of said seal assembly is in response to fluid pressure imposed upon said seal assembly.

10. A weight and pressure set seal assembly for sealing between an interior surface of an outer wellhead and the exterior surface of an inner tubular member, said inner tubular member having a tapered surface spaced from and facing the interior surface of said wellhead to form a tapered annulus comprising;

a seal assembly including, pack-off means which is tapered with the taper corresponding and contour to the tapered annulus and which in its unenergized condition is capable of entering said annulus without frictional engagement with the interior and tapered surfaces of said tapered annulus, ring means, interengageable multi-start threads on said inner tubular member and said ring means, said ring means being expandable and contractable and disposed in concentric partial overlapping relationship with said inner tubular member so that said multi-start threads on said ring means will begin to ratchet over the multi-start threads on said inner tubular member by the expansion and contraction of said ring means when said seal assembly is partially positioned within into said tapered annulus in a unenergized condition, said initial movement of said seal assembly into said tapered annulus being in response to weight imposed on said seal assembly, an abutment means between said interior surface and said tapered surface and at the lower end of said tapered annulus, and means for further shifting said seal assembly in response to fluid pressure into engagement with said abutment means after said ratcheting has taken place whereby said pack-off seal means is energized and expanded against the said interior surface and tapered surface to seal said annulus.

11. The seal assembly as claimed in claim 10 wherein said ring means upon rotation will withdraw said pack-off seal means from said tapered annulus with a minimum of friction between said pack-off seal means and said interior and tapered surfaces by reason of the taper which allows disengagement of the pack-off seal means and said surfaces with a minimum of longitudinal movement.

* * * * *